United States Patent [19]

Tieben

[11] Patent Number: 4,762,473

[45] Date of Patent: Aug. 9, 1988

[54] PUMPING UNIT DRIVE SYSTEM

[76] Inventor: James B. Tieben, Rte. 1, W. McArtor Rd., Dodge City, Kans. 67801

[21] Appl. No.: 134,547

[22] Filed: Dec. 18, 1987

Related U.S. Application Data

[63] Continuation of Ser. No. 826,196, Feb. 5, 1986, abandoned.

[51] Int. Cl.[4] ..... F15B 9/02

[52] U.S. Cl. ..... 417/399; 417/401; 60/322

[58] Field of Search ..... 60/322; 417/401, 399

[56] References Cited

U.S. PATENT DOCUMENTS

| | | | |
|---|---|---|---|
| 2,325,138 | 7/1943 | Kyle et al. | 60/372 X |
| 2,572,748 | 10/1951 | Noll et al. | 60/372 |
| 2,604,310 | 7/1952 | Brown | 417/401 X |
| 2,651,914 | 9/1953 | Joy | 60/372 |
| 3,986,355 | 10/1976 | Klaeger | 60/372 X |
| 4,047,384 | 9/1977 | Saruwatari | 60/372 |
| 4,114,375 | 9/1978 | Saruwatari | 60/372 |
| 4,530,645 | 7/1985 | Whatley et al. | 417/399 |

*Primary Examiner*—Carlton R. Croyle
*Assistant Examiner*—T. Olds
*Attorney, Agent, or Firm*—Willian Brinks Olds Hofer Gilson & Lione Ltd.

[57] ABSTRACT

A drive system for a down hole oil well pump includes a cylinder assembly which defines first and second cylinders. A pump rod which includes first and second pistons, each disposed in a respective one of the cylinders, is coupled to the down hole pump. A hydraulic accumulator supplies a resilient biasing force to one of these pistons to counter the weight of the ram interconnecting the pump rod and the down hole pump. A hydraulic pump supplies pressurized hydraulic fluid which is alternately directed against upwardly facing and downwardly facing piston faces of the pump rod to cause the pump rod to oscillate, thereby driving the down hole pump. Fluid level sensors deactivate the hydraulic pump when the oil level in the oil well falls below a pre-set level.

33 Claims, 2 Drawing Sheets

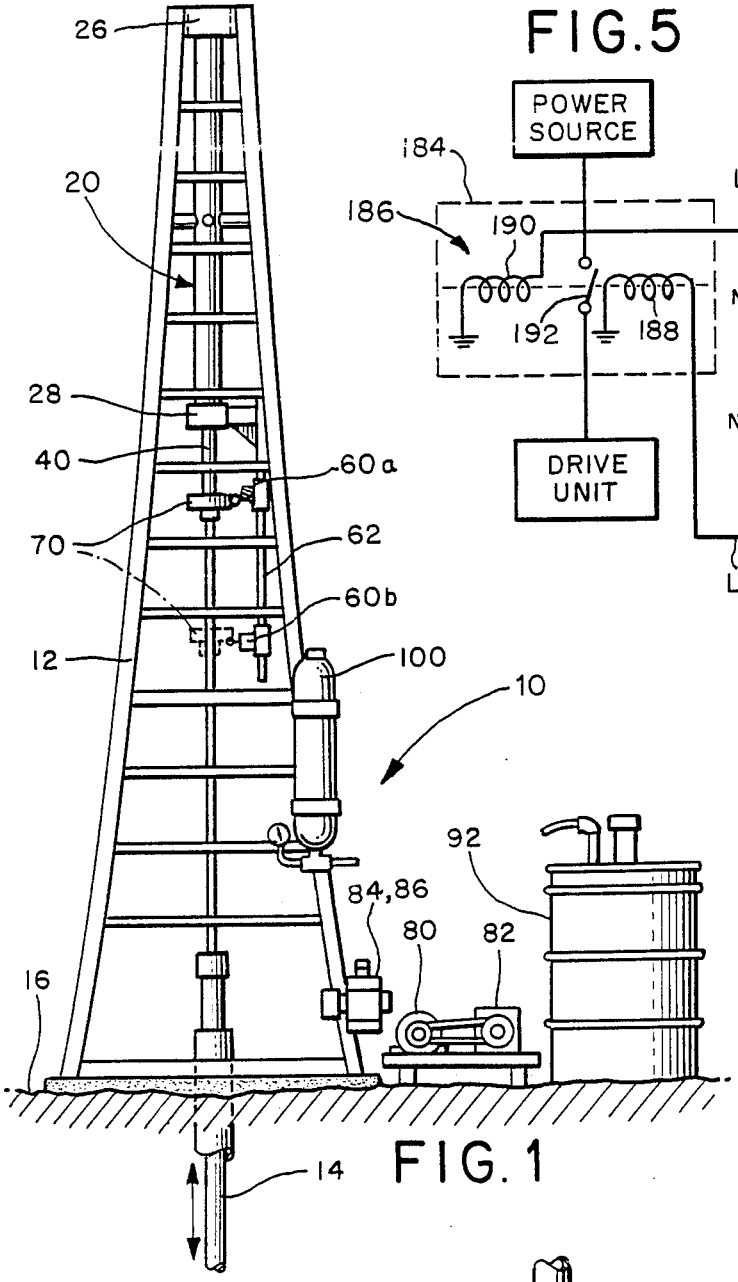
FIG. 1
FIG. 5
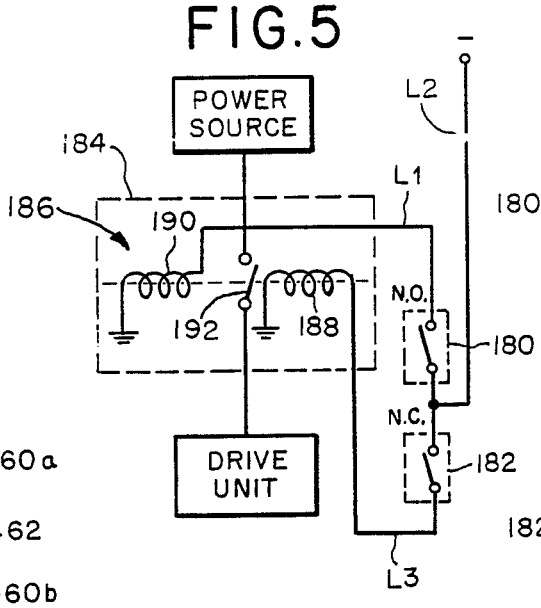
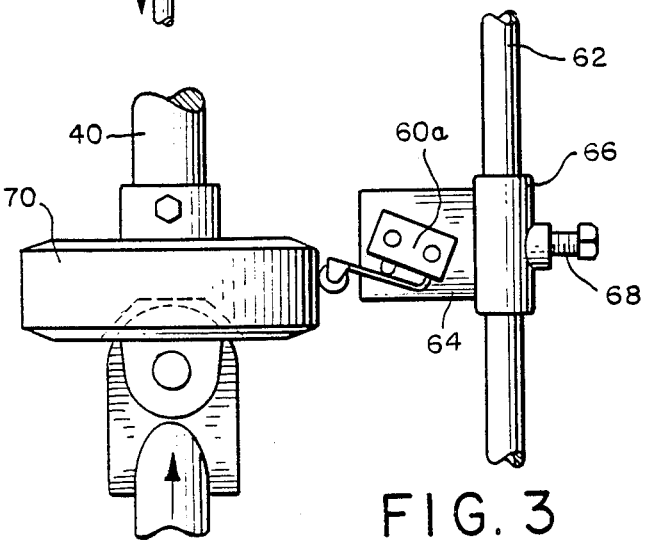
FIG. 3
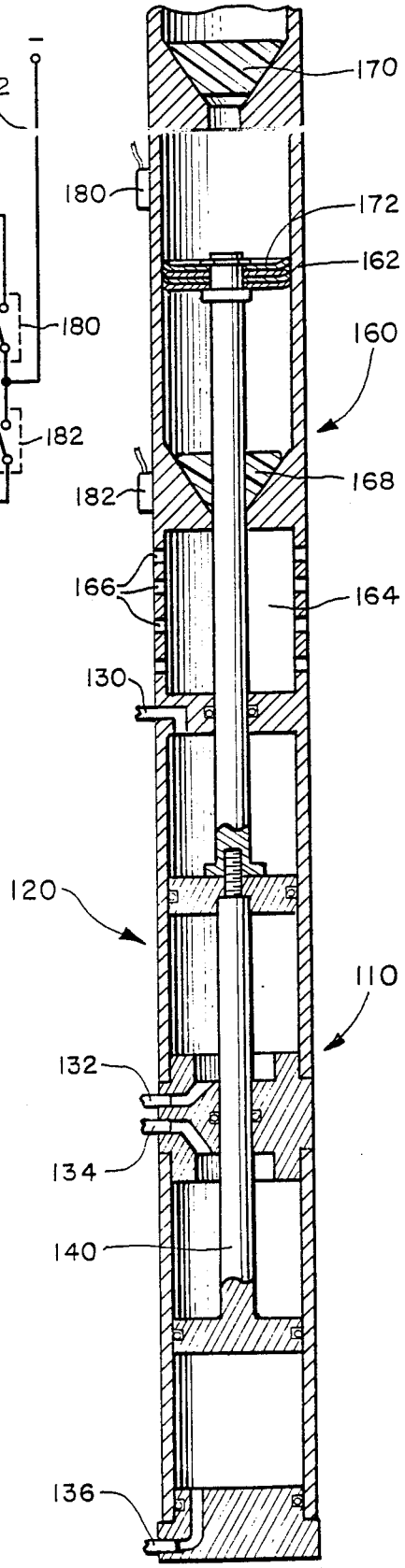
FIG. 4

PUMPING UNIT DRIVE SYSTEM

This application is a continuation of application Ser. No. 826,196, filed Feb. 5, 1986, now abandoned.

BACKGROUND OF THE INVENTION

The present invention relates to an improved pumping unit drive system for pumping fluids such as oil from an underground level to ground level.

A wide variety of pumping units are used to raise fluids such as oil to a recovery level which is typically at or near ground level. One commonly used approach is a mechanical pumping jack which uses a motor to drive a tilting beam mechanically such that the beam oscillates, thereby driving a ram alternately upwardly and downwardly to power a down hole pump. Typically, the tilting beam is provided with counterweights to reduce the load imposed on the motor.

A second approach is to utilize a motor to pressurize hydraulic fluid which operates a cylinder to alternately raise and lower the ram attached to the down hole pump. In many applications of such hydraulic drive systems, the hydraulic fluid pressurized by the motor is used both to lift the entire weight of the ram as the ram is moved upwardly and to lift less than the entire weight of the ram as the ram is allowed to move downwardly. Depending upon the depth of the well, the weight of the ram can vary considerably, and relatively high pressure hydraulic systems are often required to oscillate the ram with these prior hydraulic drive systems.

SUMMARY OF THE INVENTION

The present invention is directed to an improved drive system for a pumping unit which is simple and reliable in use, which is low in both initial capital cost and in operating cost, and which is readily adaptable to wells of varying depths and pumping rates.

This invention is intended for use with a pumping unit of the type comprising pump means for pumping fluid from beneath ground level to a recovery level which is typically at or near ground level, which comprises a pumping member which oscillates during operation of the pump means. According to this invention, a drive system which includes a hydraulic cylinder is provided. A pump rod extends into the cylinder and is coupled to the pumping member to support the pumping member. This pump rod comprises at least one piston face. Means are provided for resiliently biasing the pump rod in a selected direction to bias the pumping member upwardly and thereby support a selected portion of the load associated with the pumping member. In addition, means are provided for alternately moving the pump rod upwardly and then downwardly in order to oscillate the pump rod and the pumping member, thereby driving the pumping means.

Preferably, the means for resiliently biasing the pump rod to support the pumping member comprises a hydraulic accumulator which includes both a quantity of pressurized hydraulic fluid and a quantity of pressurizing gas. This pressurizing gas is compressed as the pump rod moves downwardly in order to store potential energy lost by the pump rod as it moves downwardly. This stored potential energy of the accumulator is then used to raise the pump rod and the pumping member on the upstroke. In this way, the power required to move the pump rod alternately upwardly and then downwardly is markedly reduced.

Preferably, the means for alternately moving the pump rod upwardly and then downwardly includes a pair of opposed piston faces on the pump rod and means for alternately directing pressurized hydraulic fluid against the first and second piston faces to oscillate the pump rod and the pumping member and thereby drive the pump means.

According to another feature of this invention, a drive unit for a pump means is provided with a control system for reducing unnecessary operation of the drive unit by measuring the down hole level of the fluid being pumped and by deactivating the drive unit when the down hole fluid level falls below a selected value. In this way, the drive unit is automatically deactivated when the fluid level is too low to allow efficient pumping, and operating costs are reduced.

The preferred embodiments described below are particularly simple, reliable and light in weight. They operate at relatively low hydraulic pressure and are characterized by a low capital cost, a low energy cost of operation, and a low maintenance cost. Because hydraulic accumulators are used to bias the pump rod upwardly, these embodiments are easily adapted to wells of varying depths and pumping members or rams of varying weights. In addition, because these embodiments use hydraulic cylinders to oscillate the pump rod, they are easily variable both in pump rate and stroke to accommodate wells of varying capacity.

The invention itself, together with further objects and attendant advantages, will best be understood by reference to the following detailed description, taken in conjunction with the accompanying drawings.

BRIEF DESCRIPTION OF THE DRAWINGS

FIG. 1 is a side elevation of portions of a first preferred embodiment of this invention.

FIG. 3 is a detailed elevation of a portion of the embodiment of FIG. 1.

FIG. 4 is a schematic view of a second preferred embodiment of this invention.

FIG. 5 is a schematic diagram of a control system included in the embodiment of FIG. 4.

DETAILED DESCRIPTION OF THE PRESENTLY PREFERRED EMBODIMENTS

Figure 2:
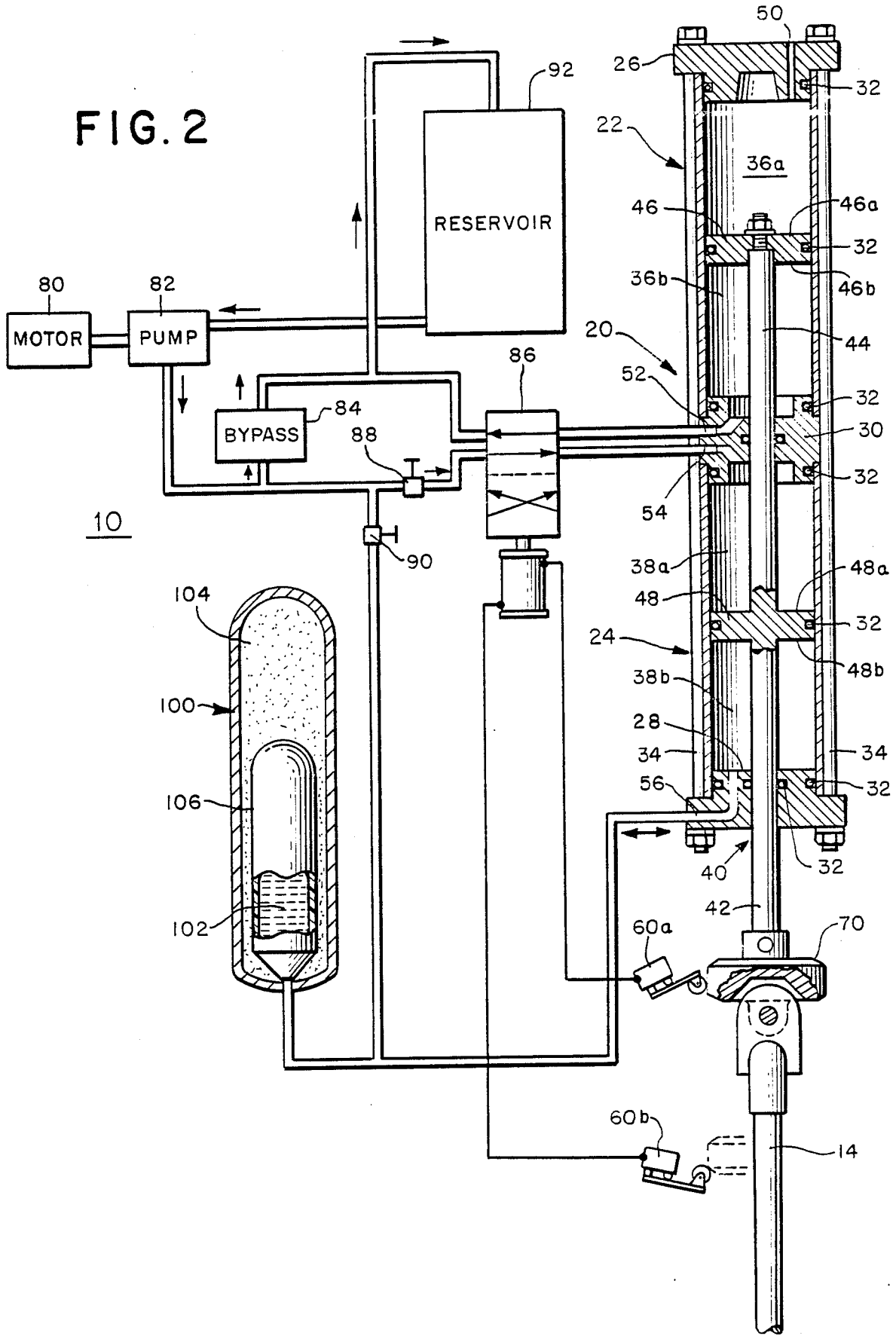
FIG. 2 is a block diagram of the embodiment of FIG. 1.

Turning now to the drawings, FIGS. 1–3 relate to a first preferred embodiment 10 of this invention. This embodiment 10 includes a tower 12 which is mounted at ground level 16 immediately above a ram 14. The ram 14 does not per se form part of this invention, but rather is a well known device of the prior art. Typically, the ram is a solid rod which extends from ground level downwardly to a down hole pump situated at the oil producing level of the well. When the ram 14 is oscillated vertically, it drives the down hole pump to pump oil from the oil producing level to a recovery level at ground level. In alternate applications, the recovery level may be beneath ground level, as for example, in certain irrigation operations when the recovery level is at the bottom of a pit.

The first embodiment 10 includes a cylinder assembly 20 which is best shown in FIG. 2. This cylinder assembly 20 includes an upper cylinder 22 and a lower cylinder 24. The upper and lower cylinders 22, 24 are joined together at the midpoint of the cylinder assembly 20 by a divider 30. In the conventional manner, four tie rods 34 extend parallel to the cylinders 22, 24 and are secured to the upper end 26 of the upper cylinder 22 and the lower end 28 of the lower cylinder 24. These tie rods 34 secure the upper and lower cylinders 22, 24 to the divider 30 and resist axial forces tending to separate these elements during operation of the cylinder assembly 20. The upper and lower cylinders 22, 24 are arranged co-axially as shown in FIG. 2.

A pump rod 40 is axially mounted within the cylinder assembly 20 for vertical movement. This pump rod 40 is made up of a lower shaft 42 which is threadedly connected to an upper shaft 44. The lower end of the lower shaft 42 is connected to the ram 14, and the pump rod 40 is generally aligned with the ram 14 vertically such that vertical oscillation of the pump rod 40 causes the ram 14 to move upwardly and downwardly. An upper piston 46 is mounted to the top of the upper shaft 44 to move in the upper cylinder 22. The upper piston 46 divides the upper cylinder 22 into upper and lower chambers 36*a*, 36*b*. The upper piston 46 defines upper and lower piston faces 46*a*, 46*b* which are directed towards the upper and lower chambers 36*a*, 36*b*, respectively. Similarly, the pump rod 40 includes a lower piston 48 which is positioned to move in the lower cylinder 24 and to divide the lower cylinder 24 into upper and lower chambers 38*a*, 38*b*. The lower piston 48 defines upper and lower piston faces 48*a*, 48*b* which face the upper and lower chambers 38*a*, 38*b*, respectively. The cylinder assembly 20 defines ports 50, 52, 54, 56 which communicate with the upper and lower chambers 36*a*, 36*b*, 38*a*, 38*b*, respectively. Conventional "O" ring seals 32 or other conventional seals are provided between the pistons 46, 48 and the cylinders 22, 24, as well as between the divider 30 and the cylinders 22, 24 and the lower end 28 and the lower shaft 42.

As best shown in FIGS. 1 and 3, upper and lower limit switches 60*a*, 60*b* are mounted alongside the lower shaft 42 by a switch rod 62. This switch rod 62 is rigidly mounted in place to the cylinder assembly 20. Each of the limit switches 60*a*, 60*b* is mounted to a respective mounting plate 64 which defines a sleeve 66 sized to slide over the switch rod 62. In each case, a respective locking screw 68 is provided to lock the mounting plate 64 and thereby the switch 60*a*, 60*b* in the desired position along the length of the switch rod 62. A cylindrical switch actuator 70 is secured to the lower shaft 42 between the upper and lower limit switches 60*a*, 60*b*. This switch actuator 70 is sized to actuate the upper limit switch 60*a* when the pump rod 40 reaches the upper limit of the selected stroke and to actuate the lower limit switch 60*b* when the pump rod 40 reaches the lower limit of the selected stroke. Of course, the desired stroke can easily be adjusted as desired simply by loosening the locking screws 68 and positioning the limit switches 60*a*, 60*b* at desired levels along the switch rod 62.

The embodiment 10 includes an electric motor 80 which drives a hydraulic pump 82. The hydraulic pump 82 pressurizes hydraulic fluid contained in a reservoir 92 and supplies this pressurized hydraulic fluid via a shut-off valve 88 to a control valve 86. A bypass valve 84 operates as a pressure relief valve, and bypasses excessive hydraulic fluid to the reservoir 92 as necessary to maintain the pressure of the hydraulic fluid passed to the control valve 86 at or below the selected pressure.

The control valve 86 in this embodiment is a pilot operated, solenoid actuated, directional control valve having two positions. Of course, other types of control valves, such as hydraulically actuated control valves, may be used in alternate embodiments. In the first position shown in FIG. 2, the control valve 86 directs pressurized hydraulic fluid to the port 54 and allows hydraulic fluid from the port 52 to return to the reservoir 92. In the first position, pressurized hydraulic fluid is directed against the upper piston face 48*a*, thereby pushing the pump rod 40 and the ram 14 downwardly. In the alternate position, the control valve 86 directs pressurized hydraulic fluid from the pump 82 to the port 52 and allows hydraulic fluid from the port 54 to return to the reservoir 92. In this alternate position, the control valve 86 directs pressurized hydraulic fluid against the lower piston face 46*b*, thereby moving the pump rod 40 and the ram 14 upwardly. The upper chamber 36*a* is vented via the port 50.

The limit switches 60*a*, 60*b* are used to control the control valve 86 automatically that such that the upper limit switch 60*a* moves the control valve 86 to the first position when the actuator 70 actuates the upper switch 60*a*, thereby causing the pump rod 40 to start moving downwardly. Conversely, when the actuator 70 reaches the lower limit switch 60*b*, the control valve 86 is moved to the second position in order to cause the pump rod 40 to begin to move upwardly. In this way, the pump rod 40 is caused to oscillate automatically, thereby oscillating the ram 14 and driving the down hole pump. In alternative embodiments, magnetic proximity sensors or hydraulic pressure sensors may be substituted for the mechanical limit switches 60*a*, 60*b* to control the control valve 86.

The embodiment 10 also includes an accumulator 100 which includes a quantity of hydraulic fluid 102 and a quantity of a pressurizing gas 104 such as nitrogen. Of course, other pressurizing gases may be used in the alternate embodiments. The hydraulic fluid 102 and the pressurizing gas 104 in the accumulator 100 are separated by a bladder 106, and the hydraulic fluid 102 is in continuous fluid communication with the port 56. The hydraulic fluid 102 in the accumulator 100 is also in communication via a shut-off valve 90 with the output of the pump 82. When desired, the shut-off valve 88 can be closed and the shut-off valve 90 opened to allow the pump 82 to pump hydraulic fluid into the accumulator 100, thereby increasing the pressure of the pressurizing gas 104. Of course, a conventional piston type accumulator may be substituted for the bladder-type accumulator 100.

In operation, the embodiment of FIGS. 1–3 is preferably used by first adjusting the quantity of hydraulic fluid 102 in the accumulator 100 to support the weight of the ram 14. This is done by closing the shut-off valve 88, opening the shut-off valve 9O, and then gradually adjusting the bypass valve 84 to increase the pressure of hydraulic fluid admitted to the accumulator 100. Pressurized hydraulic fluid 102 from the accumulator 100 is in continuous communication via the port 56 with the lower chamber 38*b*. This pressurized hydraulic fluid acts on the lower piston face 48*b* to bias the pump rod 40 upwardly. The biasing force supplied by the accumulator 100 increases as the pressure of the hydraulic fluid supplied by the pump 82 increases. At the point where this biasing force is the weight of the ram 14 and the pump rod 40 begins to rise, the shut-off valve 90 is closed, thereby sealing the accumulator 100.

Assuming no hydraulic or pneumatic leaks, the accumulator 100 is then adjusted to supply a continuous, resilient biasing force which supports substantially the entire weight of the ram 14. As the ram 14 and the pump rod 40 move downwardly, hydraulic fluid is transferred from the lower chamber 38*b* into the accumulator 100. As the pump rod 40 moves upwardly, hydraulic fluid flows in the reverse direction from the accumulator 100 to the lower chamber 38*b*. The pressurizing gas 104 thus stores the potential energy lost by the ram 14 as it moves downwardly, and then supplies this potential energy to move the ram 14 upwardly.

Because the accumulator 100 supports substantially the entire weight of the ram 14, the motor 80 and pump 82 must supply only a relatively small amount of power to cause the pump rod 40 to oscillate. In fact, the power supplied by the motor 80 and the hydraulic pump 82 is little more and that required to lift the oil pumped by the down hole pump. Preferably, the pressure in the accumulator 100 is adjusted such that the pressure supplied by the pump 82 to lift the pump rod 90 is about equal to the pressure supplied by the pump 82 to force the pump rod 40 down. In this way, the pumping capacity of the pump 82 is used most efficiently. When the pump rod 40 reaches the lower limit of its stroke, the limit switch 60*b* causes the control valve 86 to introduce pressurized hydraulic fluid from the pump 82 via the now open shut-off valve 88 to the lower chamber 36*b*, thereby directing pressurized hydraulic fluid against the lower face 46*b* of the upper piston 46 and raising the pump rod 40. When the pump rod 40 reaches the upper limit of its stroke, the upper limit switch 60*a* causes the control valve 86 to direct pressurized hydraulic fluid from the pump 82 to the upper chamber 38*a*, thereby directing the hydraulic fluid against the upper piston face 48*a* and forcing the pump rod 40 downwardly.

Of course, it should be understood that the preferred embodiment described above may readily be adapted for various applications. For example, the accumulator may be replaced in some embodiments with mechanical energy storage systems such as springs or weighted pistons. Furthermore, the accumulator described above can be used in conjunction with mechanically driven rams. The bypass valve 84 may be deleted if desired and alternate means for pressurizing the accumulator 100 are provided.

In order to better define the present preferred embodiment of this invention, the following details of construction are provided. However, it should be clearly understood that these details are intended only by way of illustration and not by way of limitation. In this embodiment the motor 80 is preferably a five horsepower electric motor, such as that sold by Granger Company of Wichita, Kans., as Model 6K13O. The pump 82 is preferably rated at 40 gallons per minute at 1200 RPM and 1000 psi, and suitable models may be obtained from Cross Manufacturing Company of Lewis, Kans. Each of the cylinders 22, 24 was formed from a 60-inch long, 4-inch diameter cylinder sold by Cross Manufacturing Company. The bypass valve 84 and control valve 86 were obtained from Parker Fluid Power of Elyira, Ohio, as model numbers ULR and D101VW1D4Y, respectively, and the bypass valve 84 has an adjustment range of 200–1000 psi. The accumulator 100 was obtained from Greer Hydraulic of Commerce, Calif., as Model No. 845390 (10 gallon).

The preferred embodiment of FIGS. 1–3 is designed for use above ground level to drive a down hole pump. FIG. 4 shows a schematic representation of a second preferred embodiment 110 which is designed for down hole use. This second embodiment 110 eliminates the need for a ram, and is particularly well suited for applications, such as slant hole wells, where rams are difficult to employ.

This second preferred embodiment 110 includes a cylinder assembly 120 similar in principle to the cylinder assembly 20 described above, and a pump rod 140 which operates in a manner similar to that described above in conjunction with pump rod 40. Furthermore, the cylinder assembly 120 includes ports 130, 132, 134, 136 which correspond to the ports 50, 52, 54, 56, respectively. The port 136 is connected to an above ground accumulator (not shown) similar to the accumulator 100. The ports 132, 134 are connected to an above ground control valve (not shown) similar to the control valve 86. In this embodiment, the ports 130, 134 are connected in parallel. This is different from the first preferred embodiment in which the upper most port 56 is vented. Of course, the cylinder assembly 120 should be packaged as appropriate for a down hole hydraulic system. Furthermore, switches which perform the function of the switches 60*a*, 60*b* should be included, and may, for example, take the form of magnetic proximity sensors in the cylinder assembly 120 or hydraulic pressure sensors above ground.

As shown in FIG. 4, the second preferred embodiment 110 is used in conjunction with a down hole pump 160 which includes a cylinder 162 which defines an inlet chamber 164. This inlet chamber 164 is in fluid communication with the oil bearing stratum via inlet ports 166. Lower and upper check valves 168, 170 are provided to cause the pump 160 to move oil upwardly. A pump piston 172 acts as a pumping member to move oil upwardly past the upper check valve 170 as it is oscillated by the pump rod 140. In this preferred embodiment, the column of oil extending between the upper check valve 170 and the surface provides a dead weight similar to that of the ram 14 which is counterbalanced by pressurized hydraulic fluid supplied via the port 136.

The embodiment of FIG. 4 includes upper and lower fluid sensors 180, 182, which are used to control the drive unit to eliminate unnecessary pumping. The sensors 180, 182 are preferably placed on the outside of the pump 160 to sense the fluid level in the bore hole annulus. As shown in FIG. 5, a voltage is applied to both of the sensors 180, 182 via a conductor L2 which extends to the surface. This voltage is passed to conductor L1 when the normally open upper sensor 180 closes, indicating that fluid level is at least as high as the upper sensor 180. In addition, this voltage is passed to the conductor L3 when the normally closed lower sensor 182 closes, indicating that fluid level is not as high as the lower sensor 182.

A motor control unit 184 is provided above ground which includes a bi-stable solenoid switch 186 that includes first and second coils 188, 190 and a contactor 192. Current through the first coil 188 closes the contactor 192, thereby supplying current to the drive unit, and current through the second coil 190 opens the contactor 192, thereby removing current from the drive unit. The first and second coils 188, 190 are connected to L1 and L3 respectively, such that current is supplied to the drive unit when the fluid rises to the level of the upper sensor 180, and until the fluid level falls to the level of the lower sensor 182. At this point, the lower sensor 182 supplies a voltage to the second coil 190 to open the contactor 192, and the drive unit remains unpowered until the fluid level reaches the upper sensor 180, and the cycle repeats.

Preferably the contactor 192 controls a drive unit which includes a motor and hydraulic pump, similar to those shown in FIG. 2, such that the motor is stopped when the fluid level falls below the lower sensor 182, and is not restarted until the fluid level rises to the upper sensor 180. In this way, unnecessary operation of the motor and pump is avoided, and operating costs are reduced.

From the foregoing, it should be apparent that the preferred embodiments of this invention provide important advantages. They are simple and reliable hydraulic systems, which do not require counterweights and are therefore light in weight. Because the accumulator is used to support the weight of the ram or the column of oil, the pump operates at relatively low pressure and the entire system is therefore relatively low in capital cost. Furthermore, because the accumulator acts in a passive manner without an external power source during operation, the energy costs required to raise oil to the surface are relatively low. Many of the hydraulic components of these embodiments are commercially available and thus repair is often a simple matter. As explained above, the stroke of the pumping unit can easily be varied as desired, as can the pumping rate. Thus, these embodiments are readily adapted for use with wells of varying depths and varying production volumes. As is apparent from FIGS. 1–3, the fluid level sensors 180, 182 and associated control system 184–192 are not required in all embodiments, and should be used only when appropriate for the particular application.

Of course, a wide range of changes and modifications can be made to the preferred embodiments described above. It is therefore intended that the foregoing detailed description be regarded as illustrative rather than limiting, and that it be understood that it is the following claims, including all equivalents, which are intended to define the scope of this invention.

I claim:

1. In combination with a pumping unit of the type comprising pump means for pumping fluid from beneath ground level to a recovery level, said pump means comprising a pumping member which oscillates during operation of the pump means, the improvement comprising:

a hydraulic cylinder;

a pump rod extending into the cylinder and adapted to support and oscillate with the pumping member, said pump rod comprising at least a first, downwardly directed piston face, and a second, upwardly directed piston face;

first means for directing pressurized hydraulic fluid from a sealed pressure vessel against the first piston face during oscillation of the pump rod to bias the pump rod upwardly to compensate for a portion of a load associated with the pumping number, said sealed pressure vessel containing both pressurized hydraulic fluid and a charge of a pressurizing gas;

a hydraulic pump;

second means for periodically directing pressurized hydraulic fluid supplied by the hydraulic pump against the second piston face to periodically force the pump rod downwardly in order to oscillate the pumping member and thereby drive the pumping means third means for introducing pressurized hydraulic fluid supplied by the hydraulic pump into the sealed pressure vessel to adjust the quantity of pressurized hydraulic fluid in the sealed pressure vessel; and means for isolating the sealed pressure vessel from the hydraulic pump during operation of the second means.

2. The invention of claim 1 wherein the pump rod additionally comprises a third, downwardly directed piston face, and wherein the second means alternately directs pressurized hydraulic fluid supplied by the hydrualic pump against the second piston face to force the pump rod downwardly and against the third piston face to force the pump rod upwardly.

3. The invention of claim 1 wherein the cylinder is adapted for use above ground.

4. The invention of claim 1 wherein the cylinder is adapted for use down hole.

5. The inventicn of claim 1 further comprising:

means for isolating the second means from the hydraulic pump during operation of the third means.

6. The invention of claim 1 wherein the pressurizing gas is nitrogen.

7. The invention of claim 1 wherein the second means comprises:

first and seocnd switches;

means for mounting the switches alongside the pump rod;

a switch actuator mounted to the pump rod to actuate the first and second switches at respective positions of the pump rod; and means for directing pressurized hydraulic fluid from the hydraulic fluid pump periodically against the second face in response to actuation of the switches by the switch actuator.

8. The invention of claim 7 wherein the switch mounting means comprises:

a switch rod extending parallel to the switch rod; and means for adjustably securing the switches in selected positions along the rod.

9. The invention of claim 1 further comprising:

at least one fluid level sensor which is mounted beneath ground level near the pump means to generate a sensor signal indicative of an excessively low fluid level; and means, responsive to the sensor signal, for deactivating the second means when the sensor signal is indicative of an excessively low fluid level.

10. In combination with a pumping unit of the type comprising pump means for pumping fluid from beneath ground level to a recovery level, said pump means comprising a pumping member which oscillates during operation of the pump means, the improvement comprising:

a hydraulic cylinder assembly which defines first and second coaxial cylinders;

a piston rod mounted for axial movement in the first and second cylinders and coupled to the pumping member, said piston rod comprising first and second pistons disposed in the first and second cylinders, respectively, said pistons dividing each of said cylinders into a respective lower chamber situated under the respective piston and a respective upper chamber situated over the respective piston;

a hydraulic fluid pump;

a hydraulic fluid accumulator which contains a quantity of pressurized hydraulic fluid and a quantity of pressurizing gas;

means for connecting the accumulator to one of the lower chambers to bias the piston rod upwardly to support a portion of a load associated with the pumping member;

means for alternately interconnecting the hydraulic fluid pump to the other of the lower chambers to raise the piston rod and the pumping member and for alternately interconnecting the hydraulic fluid pump to at least one of the upper chambers to lower the piston rod and the pumping member, thereby causing the pumping member to oscillate;

means for introducing pressurized hydraulic fluid supplied by the pump into the accumulator to adjust the quantity of pressurized hydraulic fluid in the accumulator and therefore the pressure of the pressurized hydraulic fluid in the accumulator; and means for isolating the asccumulator from the pump during operation of the alternately interconnecting means.

11. The invention of claim 10 wherein the cylinder is positioned above ground.

12. The invention of claim 10 wherein the cylinder is positioned below ground.

13. The invention of claim 10 wherein the pressurizing gas comprises nitrogen.

14. The invention of claim 10 wherein the alternately interconnecting means comprises:

first and second switches;

means for mounting the switches alongside the pump rod;

a switch actuator mounted to the pump rod to actuate the first and second switches at respective positions of the pump rod; and means for alternately passing the hydraulic fluid to said other of the lower chambers and said at least one of the upper chambers in response to actuation of the switches by the switch actuator.

15. The invention of claim 14 wherein the switch mounting means comprises:

a switch rod extending parallel to the switch rod; and means for adjustably securing the switches in selected positions along the rod.

16. The invention of claim 10 further comprising:

upper and lower fluid level sensors mounted beneath ground level adjacent to the pump means to generate respective upper and lower sensor signals, each indicative of the presence or absence of fluid at the level of the respective sensor;

means, responsive to the upper sensor signal, for activating the hydraulic fluid pump when fluid reaches the level of the upper sensor; and means, responsive to the lower sensor signal, for deactivating the hydraulic fluid pump when fluid falls to the level of the lower sensor.

17. The invention of claim 10 further comprising means for isolating the alternately interconnecting means from the pump during operation of the means for introducing pressurized hydraulic fluid supplied by the hydraulic pump into the accumulator.

18. The invention of claim 2 wherein the first, second and third piston faces are equal in size.

19. The invention of claim 2 wherein the second and third piston faces are equal in size, and wherein the first piston face is sized no larger than the second and third piston faces.

20. The invention of claim 10 wherein the first and second pistons are equal in size.

21. In a pumping unit of the type comprising pump means for pumping fluid from beneath ground level to a recovery level, said pump means comprising a pumping member which oscillates during operation of the pump means, the improvement comprising:

hydraulic cylinder means for defining first, second and third hydraulic cylinders;

piston means comprising a plurality of pistons for defining first, second and third piston faces, each positioned to move in a respective one of the first, second and third cylinders;

means for coupling the pistons with the pumping member such that the pistons support and oscillate with the pumping member;

a pressure vessel containing a pressurizing gas and a hydraulic fluid;

means for directing pressurized hydraulic fluid into the pressure vessel during setup to pressurize the pressurizing gas;

first means for directing pressurized hydraulic fluid from the pressure vessel into the first cylinder against the first piston face to bias the pumping member upwardly to compensate for a portion of a load associated with the pumping member, said pressure vessel and said first cylinder forming a sealed hydraulic system during operation;

second means for alternately directing pressurized hydraulic fluid into the second and third cylinders against the second and third piston faces in order to oscillate the pumping member and thereby drive the pumping means;

wherein the first piston face is sized no larger than the second and third piston faces.

22. The invention of claim 21 wherein the first, second and third piston faces are equal in size.

23. The invention of claim 22 wherein the coupling means comprises a piston rod which extends through the first, second and third piston faces.

24. The invention of claim 21 wherein the alternately directing means comprises a hydraulic pump and an electric motor which powers the pump.

25. The invention of claim 24 wherein the electric motor has a power rating no greater than about 5 horsepower.

26. The invention of claim 21 wherein the coupling means comprises a piston rod, and wherein the pistons are rigidly mounted to the rod such that each of the pistons surrounds the exterior of the rod and none of the piston faces extends within the rod.

27. In a pumping unit of the type comprising pump means for pumping fluid for beneath ground level to a recovery level, said pump means comprising a pumping member which oscillates during operation of the pump means, the improvement comprising:

hydraulic cylinder means for defining first, second and third hydraulic cylinders;

piston means comprising a plurality of pistons for defining first, second and third piston faces, each positioned to move in a respective one of the first, second and third cylinders;

means for coupling the pistons with the pumping member such that the pistons support and oscillate with the pumping member;

a pressure vessel containing a pressurizing gas and a hydraulic fluid;

barrier means within the pressure vessel for separating the pressurizing gas from the hydraulic fluid;

means for directing pressurized hydraulic fluid into the pressure vessel during setup to pressurize the pressurizing gas;

first means for directing pressurized hydraulic fluid from the pressure vessel into the first cylinder against the first piston face to bias the pumping member upwardly to compensate for portion of a laod associated with the pumping member, said pressure vessel and said first cylinder forming a sealed hydraulic system during operation;

second means for alternately directing pressurized hydraulic fluid into the second and third cylinders against the second and third piston faces in order to oscillate the pumping member and thereby drive the pumping means.

28. The invention of claim 27 wherein the first piston face is sized no larger than the second and third piston faces.

29. The invention of claim 28 wherein the first, second and third piston faces are equal in size.

30. The invention of claim 29 wherein the coupling means comprises a piston rod which extends through the first, second and third piston faces.

31. The invention of claim 28 wherein the alternately directing means comprises a hydraulic pump and an electric motor which powers the pump.

32. The invention of claim 31 wherein the electric motor has a power rating no greater than about 5 horsepower.

33. The invention of claim 27 wherein the coupling means comprises a piston rod, and wherein the pistons are rigidly mounted to the rod such that each of the pistons surrounds the exterior of the rod and none of the piston faces extends within the rod.

* * * * *